US006080359A

United States Patent [19]

Davidson

[11] Patent Number: 6,080,359

[45] Date of Patent: Jun. 27, 2000

[54] MARAGING STEEL

[75] Inventor: James Davidson, Varennes-Vauzelles, France

[73] Assignee: Imphy Ugine Precision, Puteaux, France

[21] Appl. No.: 09/229,566

[22] Filed: Jan. 13, 1999

[30] Foreign Application Priority Data

Jan. 23, 1998 [FR] France ..... 98 00694

[51] Int. Cl.[7] ..... C22C 38/08; C22C 38/12; C22C 38/14

[52] U.S. Cl. ..... 420/96; 148/336

[58] Field of Search ..... 420/96; 148/336

[56] References Cited

FOREIGN PATENT DOCUMENTS

| | | | |
|---|---|---|---|
| 0 051 401 | 5/1982 | European Pat. Off. . | |
| 0 327 042 | 8/1989 | European Pat. Off. . | |
| 2 127 799 | 10/1972 | France . | |
| 29446 | 2/1985 | Japan | 420/96 |
| 221555 | 11/1985 | Japan | 420/96 |
| 1089690 | 11/1967 | United Kingdom . | |

*Primary Examiner*—Deborah Yee
*Attorney, Agent, or Firm*—Oblon, Spivak, McClelland, Maier & Neustadt, P.C.

[57] ABSTRACT

A maraging steel preferably without cobalt, having the following chemical composition: Ni 18–23 wt. %, Mo 4.5–8 wt. %, Ti 1–2 wt. %, Al 0–0.3 wt. %, C≦0.01 wt. %, remainder Fe and impurities. The composition also preferably satisfies the following conditions:

Ni+Mo=23–27 wt. %, inclusively;

Ni+3×Mo+20×Ti+10×Al≧60 wt. %.

24 Claims, No Drawings

MARAGING STEEL

BACKGROUND OF THE INVENTION

1. Field of the Invention

The invention relates to a maraging steel, preferably a maraging steel without cobalt. The invention steel preferably has a high elastic limit and good ductility when aged following cold work-hardening.

2. Background of the Invention

Maraging steels are self-tempering steels which can acquire a soft martensitic structure by cooling in air, which structure can be appreciably hardened by a thermal aging treatment which gives rise to formation of intermetallic precipitates. These steels generally contain:

10–30 wt. % nickel, which enables one to obtain a martensitic structure by cooling in air;

a low carbon content which enables one to obtain a soft martensite structure; and additional elements which enable hardening by formation of intermetallic precipitates, said elements being titanium, aluminum, and molybdenum, as well as cobalt, where the presence of the cobalt enhances the effects of the other added elements.

One may also add niobium, to fix the carbon and thereby soften the un-aged martensitic structure.

Maraging steels were devised in the face of the problem of simultaneously obtaining a very high limit of elasticity and good ductility. Initially, good ductility was obtained by simultaneous addition of several wt. % of cobalt and molybdenum. However, cobalt as an alloying element is costly and not always available from a reliable source of supply. In order to avoid the constraints imposed by cobalt, maraging steels without cobalt were developed (i.e. without substantial addition of cobalt on the level set forth supra), which contain:

Ni 17–26 wt. %, Mo 0.2–4 wt. %, Ti 1–2.5 wt. %,

Al<1 wt. %, and optionally some Nb, with the remainder being Fe and impurities resulting from the processing. Such steels are described, e.g., in Brit. Pat. 1,355,475 and U.S. Pat. No. 4,443,254; both incorporated herein by reference. These steels enable one to obtain a high tensile strength (on the order of 1800 MPa) and satisfactory ductility, in a metal which is homogenized at elevated temperature followed by cooling and aging.

OBJECTS OF THE INVENTION

For certain applications it is desirable to obtain a maraging steel with an elastic limit above 1900 MPa an elongation at failure of >6.5%, especially for metal which is aged directly after being cold rolled. Such an application, for example, is for maraging steel in the form of thin strips from which clock and watch parts, and conveyor belts and the like, are fabricated. Accordingly, one object of the invention is a maraging steel having such properties; and particularly, when used in the form of a thin cold-rolled strip.

DETAILED DESCRIPTION OF THE INVENTION

The invention steel accomplishes this object, and is a maraging steel without added cobalt, which steel comprises, consists essentially of, or consists of the following chemical composition:

Ni 18–23 wt. %, Mo 4.5–8 wt. %, Ti 1–2 wt. %,

Al 0–0.3 wt. %, C≦0.01 wt. %, iron, and impurities; wherein the composition also preferably satisfies the following conditions:

Ni+Mo=23–27 wt. %, inclusively;

Ni+3×Mo+20×Ti+10×Al≧60 wt. %.

This steel preferably has a limit of elasticity, Re, ≧1900 MPa, and an elongation at failure of ≧6.5% when cold rolled (or otherwise reduced in thickness by cold working) followed by aging, the cold rolling or other cold-working, reduction in thickness being in the range 0–50%, preferably 10–45%.

The invention will be further described in detail hereinbelow, and will be illustrated in the form of examples.

Preferred invention maraging steels comprise:

Ni 18–23 wt. %, preferably >19 wt. %, and

Mo 4.5–8 wt. %, preferably >5 wt. %; with

Ni+Mo=23–27 wt. %, preferably 24–26 wt. %, and preferably the temperature of the beginning of transformation to martensite is neither too high nor too low, from a practical viewpoint and the hardening effect obtained from the molybdenum is sufficient for ordinary and exceptional purposes.

The invention steels also preferably comprises:

Ti 1–2 wt. %, preferably <1.6 wt. %, and

Al 0–0.3 wt. %, and preferably the precipitation-hardening obtained is sufficient, and the risk of defects developing during hot-rolling is limited.

Further, the carbon content is preferably limited to ≦0.01 wt. %, so as to obtain a martensite which is sufficiently soft prior to aging. The remainder of the composition comprises, consists essentially of or consists of iron, and impurities resulting from the processing.

The invention steel can be prepared in the molten state, cast into ingots, and then hot-rolled, according to the state of the art. It may also be cold-rolled, e.g. to obtain a strip of thickness of e.g., less than 1.5 mm. For cold-rolling, depending on the initial and desired final thicknesses, the cold-rolling may be carried out in a plurality of stages separated by annealing at temperatures ≧800° C. One may provide, in particular, that the final stage of cold-rolling represents a cold-working reduction in the range 0–50%, preferably in the range 10–45%, and particularly preferably <35%. In this case, after aging at, e.g., 450–510° C., the elastic limit, Re, obtained is greater than 1900 MPa and the elongation at failure (A) is >6.5%.

EXAMPLES

For purposes of example, ingots designated 1–7 were produced (see Table below) according to the invention, along with an ingot designated A according to the prior art. These ingots were used to prepare cold-rolled strip wherewith the final cold-rolling stage involved annealing at 1020° C. The strip was then hardened by aging at 480° C. for 4 hr, following which the mechanical characteristics were measured by a tensile strength test.

TABLE

Chemical compositions of the steels (wt. %):

| Sample | Ni | Mo | Ti | Al | C | Fe |
|---|---|---|---|---|---|---|
| 1 | 19.66 | 4.84 | 1.34 | 0.14 | 0.0021 | bal. |
| 2 | 19.30 | 5.07 | 1.42 | 0.1 | 0.0015 | bal. |

TABLE-continued

| Chemical compositions of the steels (wt. %): | | | | | | |
|---|---|---|---|---|---|---|
| Sample | Ni | Mo | Ti | Al | C | Fe |
| 3 | 19.86 | 4.62 | 1.29 | 0.11 | <0.001 | bal. |
| 4 | 20.28 | 5.06 | 1.24 | 0.11 | <0.001 | bal. |
| 5 | 20.81 | 4.61 | 1.28 | 0.12 | <0.001 | bal. |
| 6 | 18.86 | 6.58 | 1.23 | 0.13 | 0.0087 | bal. |
| 7 | 19.4 | 6.55 | 1.23 | 0.13 | 0.0015 | bal. |
| A comparison | 18.13 | 2.92 | 1.36 | 0.14 | 0.0031 | bal. |

The results of the mechanical tests were as follows:

| Sample 1 (Invention): | | | | | |
|---|---|---|---|---|---|
| Reduction in Dimensions (%) | 0% | 25% | 50% | 75% | |
| Re (MPa) | 1856.5 | 1934.5 | 2001.5 | 2138.5 | |
| A% | 7.13 | 7.67% | 7% | 3.54% | |
| **Sample 2 (Invention)** | | | | | |
| Reduction in Dimensions (%) | 0% | 7,4% | 24,1% | 45,9% | 72,9% |
| Re (MPa) | 1946 | 1979.1% | 2029.5 | 2120.2 | 2268 |
| A% | 6.88% | 7.3% | 7.07% | 6.65% | 2.87% |
| **Sample 3 (Invention)** | | | | | |
| Reduction in Dimensions (%) | 0% | 5,4% | 22,7% | 48,2% | 74,6% |
| Re (MPa) | 1887.4 | 1932.3 | 1912 | 1994.8 | 2127.5 |
| A% | 7.65% | 7.96% | 7.47% | 6.83% | 2.57% |
| **Sample 4 (Invention)** | | | | | |
| Reduction in Dimensions (%) | 0% | 3% | 19,2% | 44,6% | 71,2% |
| Re (MPa) | 1840.6 | 1967.6 | 1967.6 | 2001.2 | 2198.2% |
| A% | 9.48% | 10.08% | 8.85% | 8.24% | 7.79% |
| **Sample 5 (Invention)** | | | | | |
| Reduction in Dimensions (%) | 0% | 4% | 22% | 48,4% | 74,5% |
| Re (MPa) | 1852.1 | 1908.8 | 1907.7 | 2032.5% | 2197.5 |
| A% | 8.99% | 8.17% | 7.39% | 5.59% | 3.32% |
| **Sample 6 Invention)** | | | | | |
| Reduction in Dimensions (%) | 0% | 8% | 25,2% | 49,8% | 74% |
| Re (MPa) | 1956.3 | 2043.6 | 2097 | 2216.1 | 2318.6 |
| A% | 9.64% | 9.02% | 8.65% | 7.93% | 6.32% |
| **Sample 7 (Invention)** | | | | | |
| Reduction in Dimensions (%) | 0% | 8,8% | 23,5% | 48,8% | 74,3% |
| Re (MPa) | 1696.7 | 1836.5 | 2012.5 | 2151.1 | 2336.7 |
| A% | 9.93% | 8.37% | 8.25% | 7.05% | 3.98% |
| **Sample A (Comparison)** | | | | | |
| Reduction in Dimensions (%) | 0% | 25% | 50% | 75% | |
| Re (MPa) | 1724 | 1771 | 1861 | 1965.5 | |
| A% | 9.3% | 8.94% | 10.16% | 6.1% | |

The results, taken together, demonstrate that:

steels according to the invention enable one to obtain simultaneously an elastic limit >1900 MPa and an elongation at failure >6.5%, if the aging treatment is carried out directly after cold working (e.g. cold-rolling) with a reduction in thickness in the range 0–50%; and this combination of properties is not possible with the steel according to the prior art.

As noted above, the invention steel most preferably contains no added cobalt. The term "no added cobalt" means no active addition of cobalt during preparation. It is a fact of steel processing that various impurities exist as unwanted components of desired materials. The term "no added cobalt" does not exclude impurity level cobalt. Thus, the invention steel can include low impurity levels of cobalt not intentionally present but added with other components. Such impurity levels are included in the art-common terms "impurities" and "impurities resulting from smelting (processing)."

French patent application 98 00694 is incorporated herein by reference.

What is claimed is:

1. A maraging steel comprising iron, no added cobalt, and the following elements in the indicated wt. amounts based on total weight:

Ni 18–23 wt. %, Mo 4.5–8 wt. %, Ti 1–2 wt. %,

Al 0–0.3 wt. %, C≦0.01 wt. %, wherein the steel composition also satisfies the following conditions:

Ni+Mo=23–27 wt. %, inclusively;

Ni+3×Mo+20×Ti+10×Al≧60 wt. %.

2. A maraging steel according to claim 1, wherein Mo≧5 wt. %.

3. A maraging steel according to claim 1, wherein Ni≧19 wt. %.

4. A maraging steel according to claim 1, wherein Ni+Mo=24–26 wt. %.

5. A maraging steel according to claim 1, wherein Ti<1.6 wt. %.

6. A maraging steel according to claim 1, wherein said steel has a limit of elasticity, Re, >1900 MPa, and elongation at failure >6.5% when cold rolled or otherwise reduced in thickness by cold working in the range 0–50% followed by aging.

7. A maraging steel according to claim 6, wherein the steel is reduced in thickness by 10–45%.

8. A maraging steel according to claim 7, wherein the steel is reduced in thickness, and the reduction in thickness is <35%.

9. A maraging steel according to claim 2, wherein Ni≧19 wt. %.

10. A maraging steel according to claim 2, wherein Ni+Mo=24–26 wt. %.

11. A maraging steel according to claim 3, wherein Ni+Mo=24–26 wt. %.

12. A maraging steel according to claim 2, wherein Ti≦1.6 wt. %.

13. A maraging steel according to claim 3, wherein Ti≦1.6 wt. %.

14. A maraging steel according to claim 4, wherein Ti≦1.6 wt. %.

15. A maraging steel according to claim 2, wherein said steel has a limit of elasticity, Re, ≧1900 MPa, and elongation at failure ≧6.5% when cold rolled or otherwise reduced in thickness by cold working in the range 0–50% followed by aging.

16. A maraging steel according to claim 3, wherein said steel has a limit of elasticity, Re, ≧1900 MPa, and elongation at failure ≧6.5% when cold rolled or otherwise reduced in thickness by cold working in the range 0–50% followed by aging.

17. A maraging steel according to claim 4, wherein said steel has a limit of elasticity, Re, ≧1900 MPa, and elongation at failure ≧6.5% when cold rolled or otherwise reduced in thickness by cold working in the range 0–50% followed by aging.

18. A maraging steel according to claim 5, wherein said steel has a limit of elasticity, Re, ≧1900 MPa, and elongation at failure >6.5% when cold rolled or otherwise reduced in thickness by cold working in the range 0–50% followed by aging.

19. A maraging steel according to claim 15, wherein the steel is reduced in thickness by 10–45%.

20. A maraging steel according to claim 19, wherein the steel is reduced in thickness, and the reduction in thickness is <35%.

21. The maraging steel according to claim 1, which consists essentially of iron, no added cobalt, and the following elements in the indicated wt. amounts based on total weight:

Ni 18–23 wt. %, Mo 4.5–8 wt. %, Ti 1–2 wt. %,

Al 0–0.3 wt. %, C≦0.01 wt. %, wherein the steel composition also satisfies the following conditions:

Ni+Mo=23–27 wt. %, inclusively;

Ni+3×Mo+20×Ti+10×Al≧60 wt. %.

22. The maraging steel according to claim 1, which consists of iron, no added cobalt, and the following elements in the indicated wt. amounts based on total weight:

Ni 18–23 wt. %, Mo 4.5–8 wt. %, Ti 1–2 wt. %,

Al 0–0.3 wt. %, C≦0.01 wt. %, wherein the steel composition also satisfies the following conditions:

Ni+Mo=23–27 wt. %, inclusively;

Ni+3×Mo+20×Ti+10×Al≧60 wt. %.

23. The maraging steel according to claim 1 wherein cobalt is present only as an impurity.

24. The maraging steel according to claim 1, wherein chromium is present only as an impurity.

* * * * *